US005392538A

United States Patent [19]

Geerligs et al.

[11] Patent Number: 5,392,538

[45] Date of Patent: Feb. 28, 1995

[54] EXTENDABLE DRAG PLOW

[76] Inventors: Gerald J. Geerligs, 4711 92nd St., Caledonia, Mich. 49316; Rick A. Geerligs, 2738 Quincy St., Hudsonville, Mich. 49426

[21] Appl. No.: 70,266

[22] Filed: Jun. 2, 1993

[51] Int. Cl.[6] ..... E01H 5/06

[52] U.S. Cl. ..... 37/268; 37/236; 37/266

[58] Field of Search ..... 37/266, 331, 407, 416, 37/236; 172/791, 793, 795, 797, 815, 827, 667, 684.5, 741, 701.1; 414/724, 912, 703

[56] References Cited

U.S. PATENT DOCUMENTS

| | | | |
|---|---|---|---|
| Re. 31,045 | 10/1982 | Essell et al. . | |
| 2,014,783 | 9/1935 | Schubert . | |
| 2,763,944 | 9/1956 | Magee et al. . | |
| 2,830,391 | 4/1958 | Bruno et al. . | |
| 3,022,587 | 2/1962 | Greeley | 172/795 |
| 3,231,991 | 2/1966 | Wandscheer et al. . | |
| 3,651,587 | 3/1972 | Plasser et al. | 172/815 |
| 3,803,733 | 4/1974 | Ramsey . | |
| 3,807,064 | 4/1974 | Schmidt, Jr. . | |
| 4,275,514 | 6/1981 | Maura . | |
| 4,369,847 | 1/1983 | Mizunuma | 172/815 |
| 4,630,686 | 12/1986 | Ausmus, Jr. | 172/393 |
| 4,667,426 | 5/1987 | Howard et al. . | |
| 4,802,293 | 2/1989 | Smith | 37/381 |
| 4,808,026 | 2/1989 | Clarke, Jr. et al. | 172/381 X |
| 4,907,357 | 3/1990 | Lilienthal | 37/266 X |
| 5,048,207 | 9/1991 | Verseef . | |
| 5,058,295 | 10/1991 | Holland | 37/268 |

*Primary Examiner*—Dennis L. Taylor
*Assistant Examiner*—Victor Batson
*Attorney, Agent, or Firm*—Glenn B. Morse

[57] ABSTRACT

The extendable drag plow provided by this invention has a laterally-fixed center section, and moveable outer sections positioned by a controllable actuator system. The moveable plow sections are equipped with followers engaging oppositely-extending pairs of guideways in the central plow section, with the actuators positioned between these pairs. A lifting actuator extends between pivotal connections to a bracket mounted on the vehicle and a terminal fixed with respect to the central plow section. Drag arms are also pivotally connected to a bracket mounted on the vehicle and are secured at their opposite end to the central plow section. A diagonal brace extending between the top portion of the central plow section and the drag arm is also used as a terminal for the actuator.

4 Claims, 6 Drawing Sheets

EXTENDABLE DRAG PLOW

BACKGROUND OF THE INVENTION

Snow plowing in residential and commercial areas has become a fine art, and is practiced by contractors on a seasonal or individual job basis. Plow assemblies are designed for attachment to standard vehicles-usually pick-up trucks. Lifting and positioning of the plow blade is usually done with hydraulic actuators operating on pressure generated by a pump driven by the vehicle engine. Occasionally, electric screw jacks are used.

A drag plow is often mounted on the back of the vehicle as a supplement to the action of the front-mounted principal plow. The vehicle is backed up to an obstruction with the plow raised. It is then lowered. A typical use of the drag plow is in pulling snow away from a wall or a garage door far enough for the operator to then swing the vehicle around and move the snow off to the side with the main plow. The load on this type of plow is thus relatively light. In the interest of saving time, these plows have been designed for lateral extension from a retracted central position to an extended position sweeping a path about twice as wide. The conditions under which these plows operate dictate that simplicity and ruggedness are a prime requirement.

SUMMARY OF THE INVENTION

The present invention provides an extendable plow with a simple and rugged structure including a lifting actuator system interposed between structure fixed with respect to the carrying vehicle and a terminal fixed with respect to the central plow section. Opposite moveable plow sections are positioned by pairs of oppositely-extending guideways on the central plow section, each of the moveable plow sections having followers engaging one guideway of each of the pairs. The actuators are positioned between the pairs to balance the guideway resistance with respect to the force axis of the actuators.

DESCRIPTION OF THE PREFERRED EMBODIMENT

Figure 1:
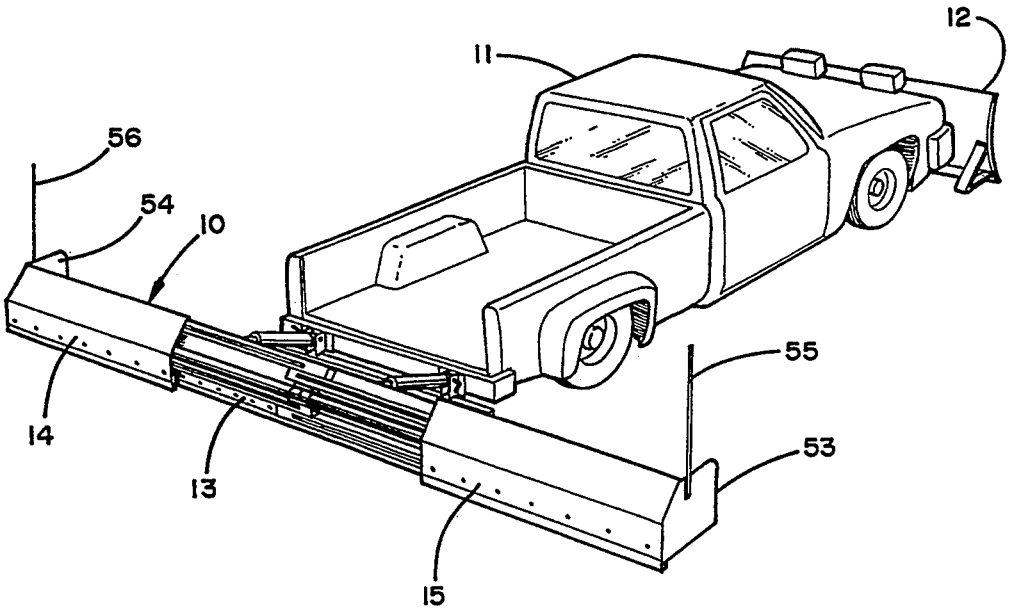
FIG. 1 is a perspective view of an extended drag plow mounted on a pick-up truck.

Referring to FIG. 1, the extendable plow generally indicated at 10 is shown mounted at the rear of the pick-up truck 11. The conventional front-mounted plow

Figure 3A:
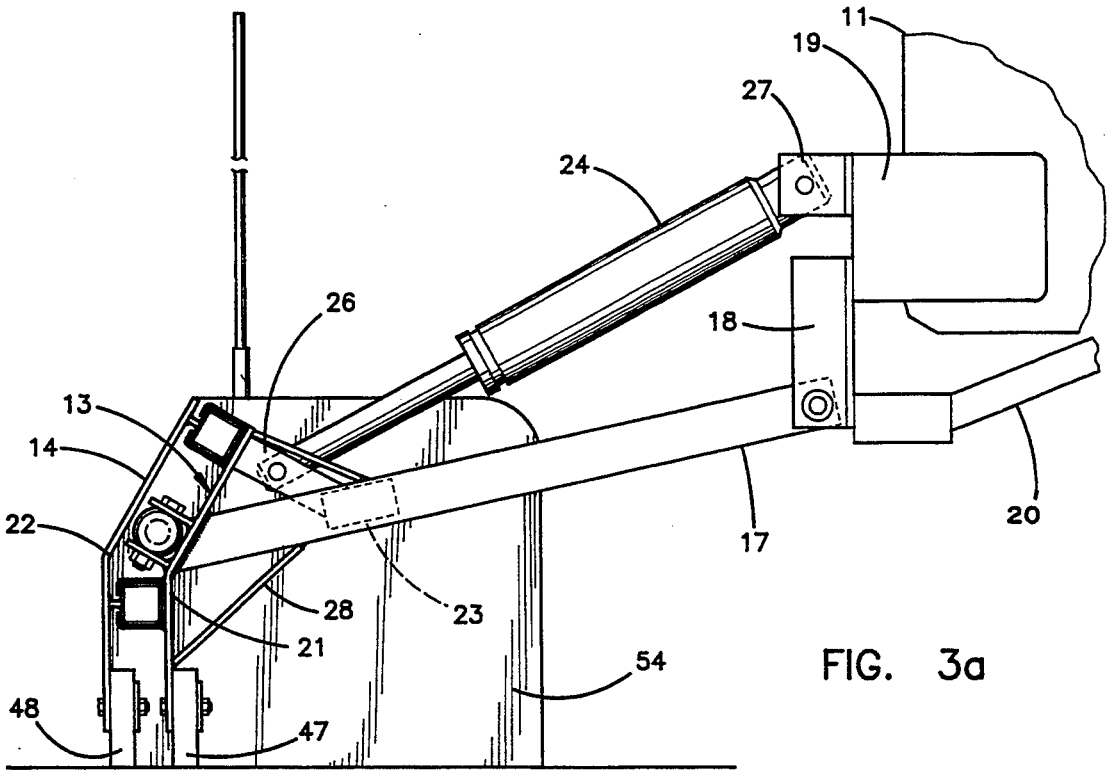
FIG. 3*a* is a side elevation showing the plow in the lowered position.
Figure 3B:
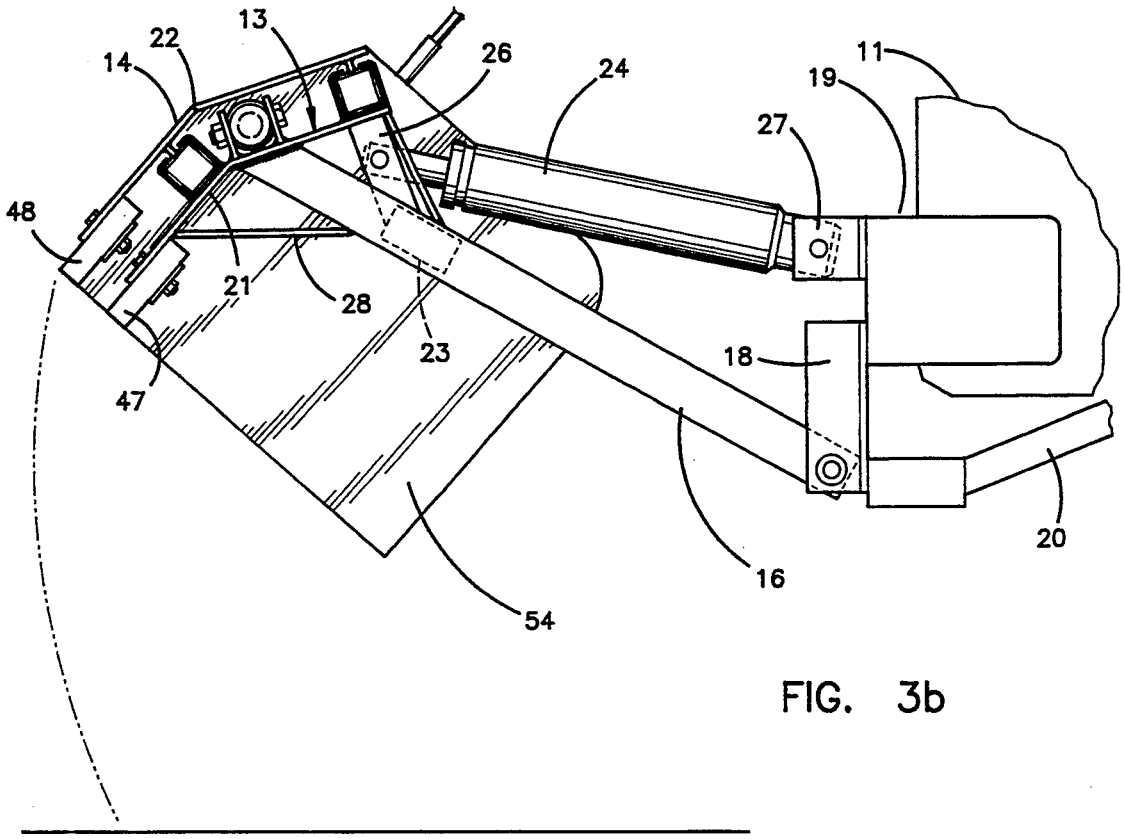
FIG. 3*b* is a view of the structure shown in FIG. 3*a*, but in the elevated position.

12 is responsible for most of the heavy work in moving the snow, while the extendable plow 10 is usable to drag accumulations of snow away from walls or doorways to a point where it can be handled more easily by the front plow 12. The extendable plow 10 has a central blade section 13 which remains laterally fixed with respect to the vehicle 11. The moveable plow sections 14 and 15 are slidable with respect to the central plow section 13 under the action of an actuator system. Drag arms 16 and 17 are pivotally connected to brackets as shown at 18 in FIGS. 3*a* and 3*b* mounted on the bumper 19 of the truck. Preferably, a diagonal brace 20 stabilizes the bracket 18 with a connection to the frame of the truck at a convenient point.

Figure 2:
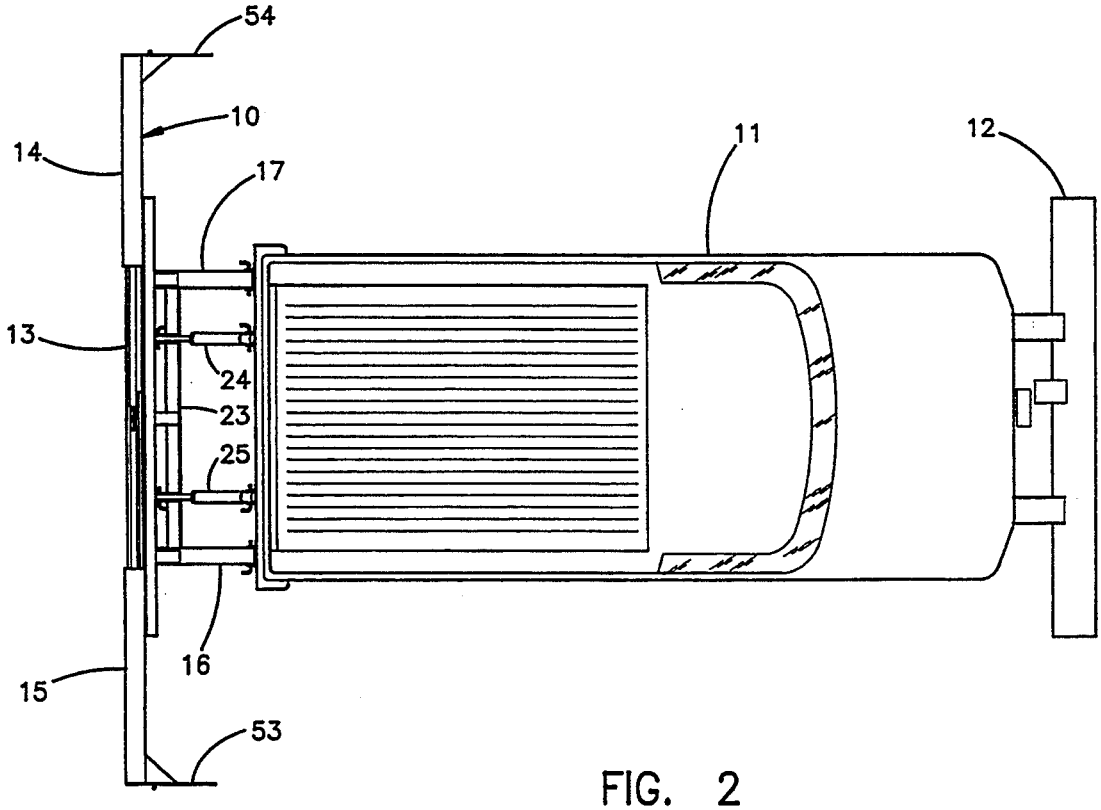
FIG. 2 is a top view of the arrangement shown in FIG. 1.

The central plow section 10 has a bend indicated at 21 on a horizontal axis at about the midpoint of its height. The moveable plow sections 14 and 15 also have similar bends as shown at 22 in FIGS. 3*a* and 3*b*, so that the surfaces of these plow sections may be considered as being in spaced parallel planes. A beam 23 is connected at its opposite ends to the drag arms 16 and 17, and the lifting actuators 24 and 25 (refer to FIG. 2) extend between the diagonal braces 26 and terminal brackets as shown at 27 in FIGS. 3*a* and 3*b* mounted on the truck. Pivotal connections are provided at both ends of these actuators. The diagonal brace 26 extends between the beam 23 and the upper extremity of the central plow section 21. Preferably, a lower diagonal brace 28 extends from the drag arms to the lower portion of the central plow section to stabilize it against excessive deflection. This arrangement provides a rugged construction that is easy to manufacture, and also easy to maintain.

Figure 4:
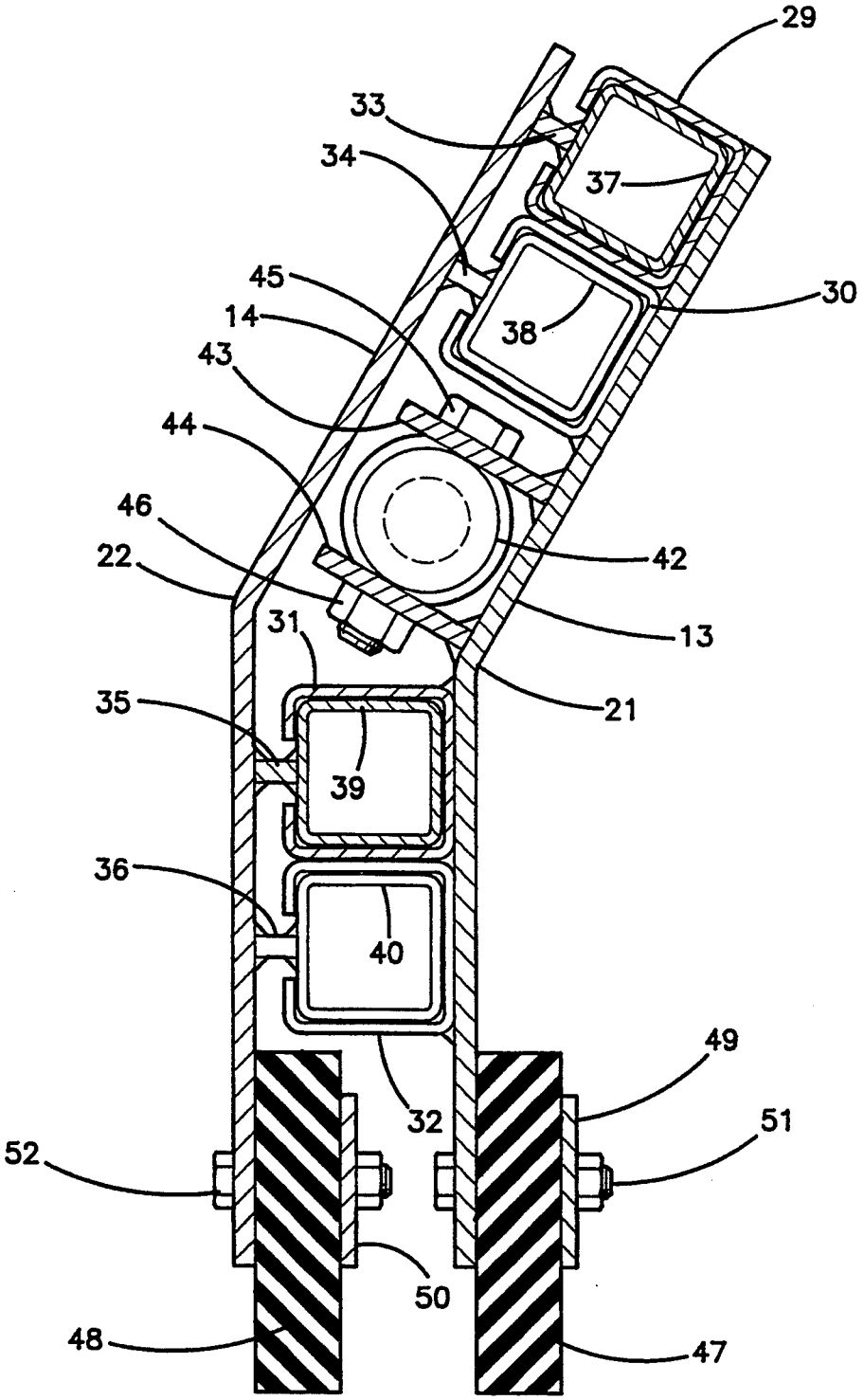
FIG. 4 is a typical cross-section on an enlarged scale of the plow assembly.
Figures 5A, 5B:
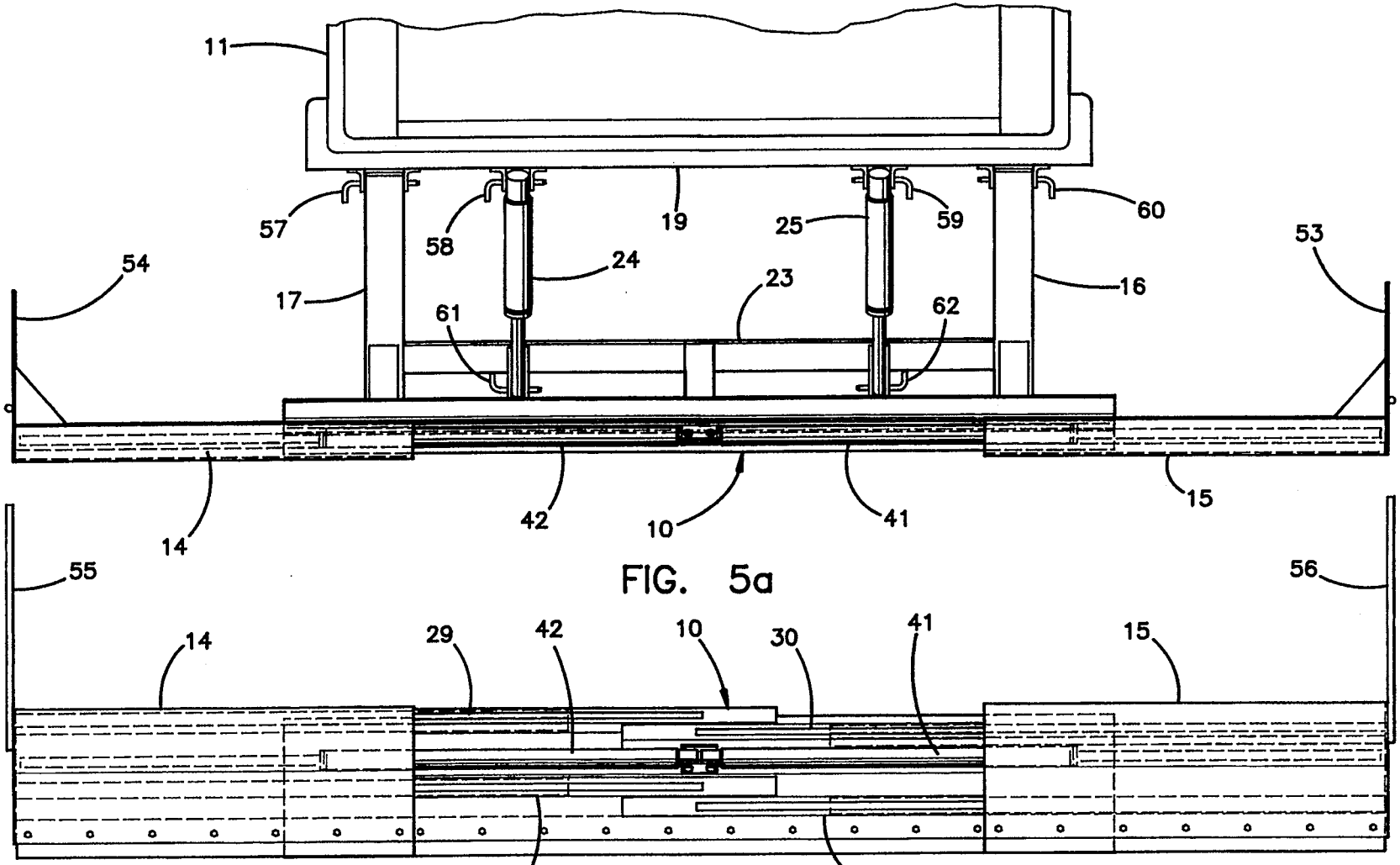
FIG. 5*a* is a top view of the extended position of the plow.
FIG. 5*b* is a rear view (with respect to the direction and movement of the vehicle) of the structure shown in FIG. 5*a*.
Figures 6A, 6B:
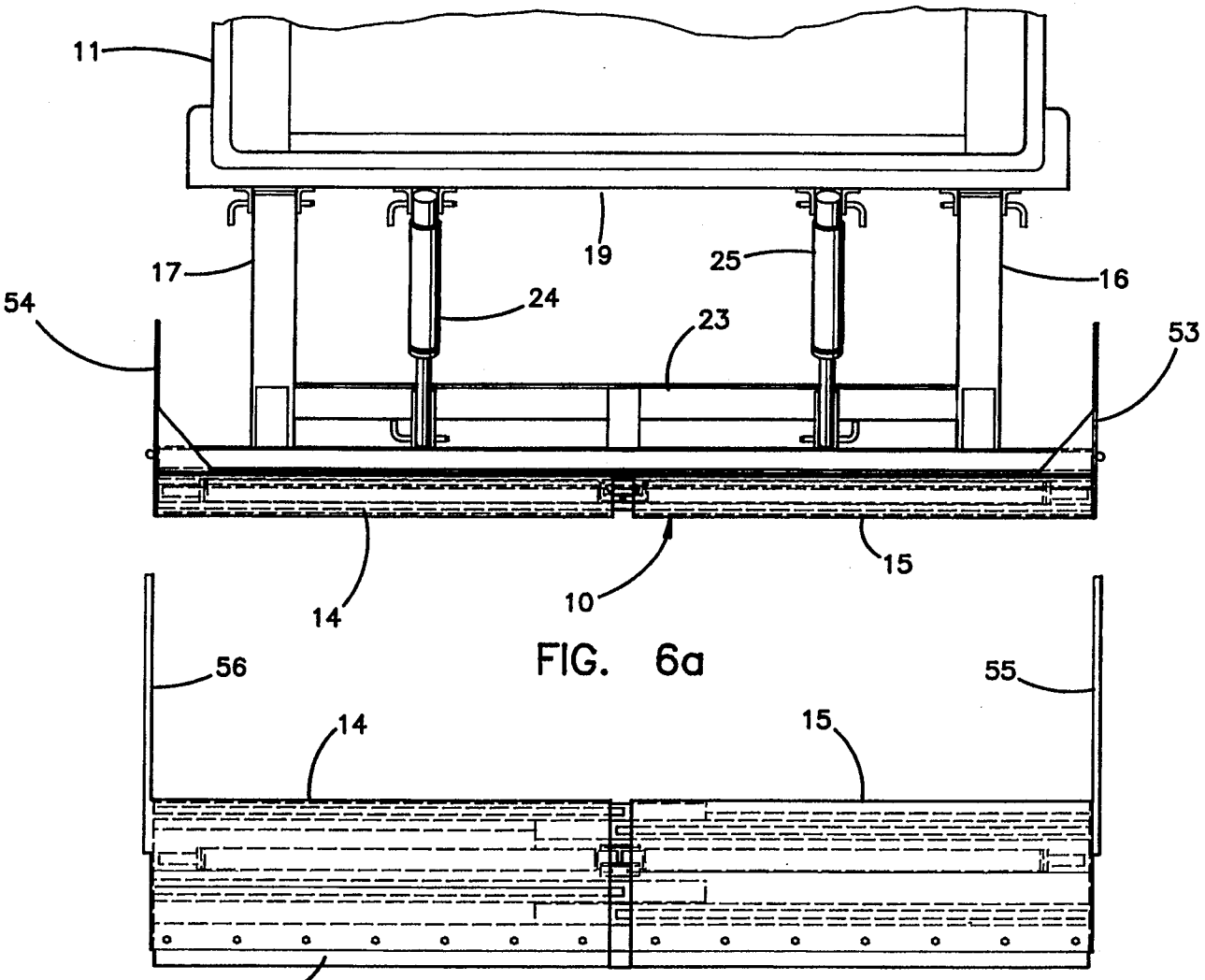
FIG. 6*a* is a top view of the plow assembly in the retracted position.
FIG. 6*b* is a rear view with respect to FIG. 6*a*.
Figure 7:
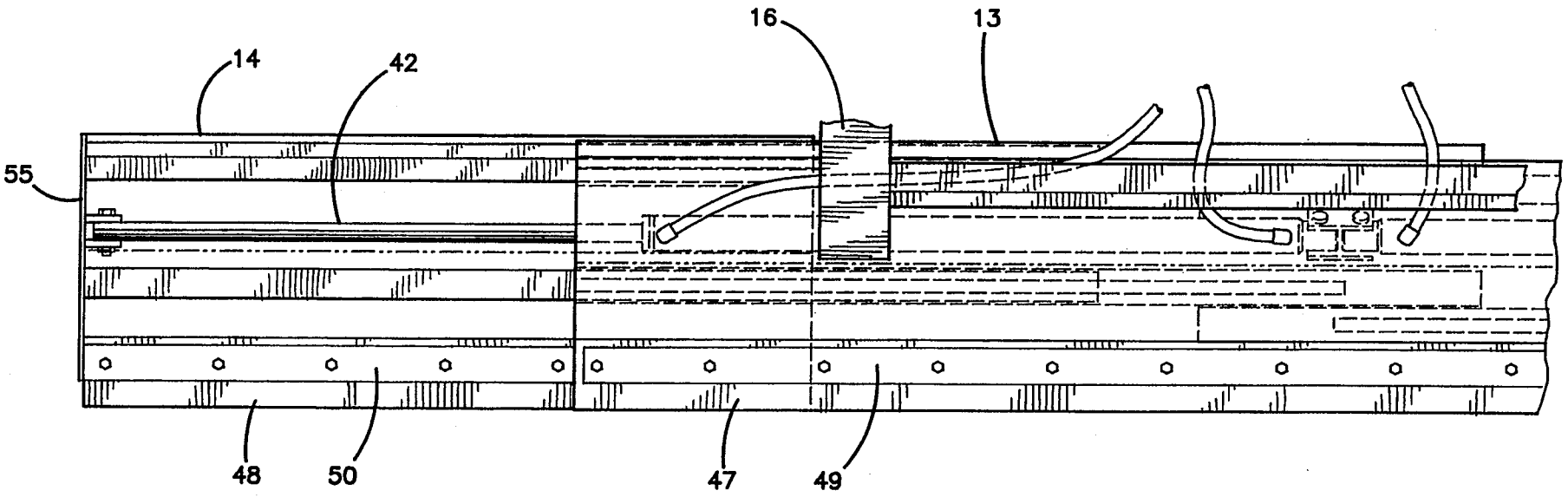
FIG. 7 is a partial view of the front of the assembled plow assembly, showing slightly more than half of the total width of the assembly.

Referring particularly to FIGS. 4 and 5*b*, the plow sections 13–15 are essentially pieces of heavy bent sheet steel. The thickness and lateral dimensions may vary according to preference. The laterally-fixed central plow section 13 is provided with guideways as shown at 29–32 in FIG. 4. These guideways are square-section steel tubes slotted on their rear face so that short webs as shown at 33–36 can extend through the slots to connect the followers 37–40 to the moveable plow sections. The followers are short sections of square steel tube receivable within the guideways. The guideways are arranged in upper and lower pairs, the guideways of each pair extending in opposite directions. Each of the moveable plow sections will have a follower engaging one guideway of each of these pairs, as shown best in FIG. 4*b*. The preferably coaxial hydraulic actuators 41 and 42 are mounted between the guideway pairs, and thus provide for a balance of the resistance forces in the guideways on the opposite sides of the thrust axis provided by the actuators. Excessive eccentricity between the actuator and the guideways necessarily results in increased resistance to movement, and possibly a total jamming action. The actuators are preferably attached at their opposite ends to tabs as shown at 43 and 44 welded to the plow sections, with bolts as shown at 45 traversing the tabs and the appropriate end terminals of the standard actuators. Removal of the nuts 46 makes it possible to separate the components easily whenever this is desirable. The followers show in FIG. 4 are all considerably shorter than the guideways. However, in the closed position of the plow assembly, the followers are fully received in the inner ends of the guideways,. The length of the followers is selected to establish the necessary interengagement with the guideways to assure the stability of the extended position of the moveable plow sections. There is no need for such concern in the retracted position.

Referring to FIG. 4, the lower extremity of all the plow sections is defined by elongated rubber blocks as shown at 47 and 48 in FIG. 4. These are secured to the respective plow sections by clamping plates 49 and 50 secured by bolts 51 and 52. The engagement of the plow sections with rough ground is thus given a more effective sweeping action, and also considerably reduces the level of sound from the action of the plow. The moveable plow sections are also provided with end plates as shown at 53 and 54 in FIG. 5*a* to prevent the accumulated snow from moving around the ends of the extended plow. Vertically-extending gauge rods 55 and 56, as shown in FIGS. 1 and 5*b* are preferably welded to the end plates to give the operator of the truck a better indication of the path that the plow is following.

Several of the active components of the plow assembly are connected by removable pins as shown at 57–62 in FIG. 5*a*. This arrangement facilitates the assembly and disassembly of the system to the vehicle. It should be noted that the usual hydraulic lines and fittings associated with the actuators have been omitted from all of the views, in the interests of clarity.

I claim:

1. An extendable drag plow, comprising:

a central plow section having vertically spaced horizontal guideways;

at least one laterally moveable plow section having members engaging said guideways for movement of said moveable plow section from a retracted central position overlapping said central plow section to a laterally extended position;

shifting actuator means adapted to induce said movement;

bracket means adapted for mounting on a vehicle;

laterally-spaced drag arm means pivotally connected to said bracket means;

a laterally-extending beam interconnecting said drag arm means;

diagonal brace means connecting the upper extremity of said central plow section to an intermediate point on said beam; and lifting actuator means pivotally connected to said bracket means and to said diagonal brace means.

2. A plow as defined in claim 1, wherein said plow sections have opposite bends on horizontal axes, respectively, and said drag arm is connected to said central plow section at said bend thereon.

3. A plow as defined in claim 2, wherein said guideways are disposed above and below said bend.

4. An extendable drag plow including a central plow section having vertically spaced horizontal guideways, opposite laterally moveable plow sections having follower members engaging said guideways for movement of said moveable plow sections from a retracted central position overlapping said central plow section to a laterally extended position, shifting actuator means adapted to induce said movement, bracket means adapted for mounting on a vehicle, and drag arm means connected to said central plow section, wherein the improvement comprises:

an arrangement of said guideways and follower members including adjacent pairs of oppositely extending guideways, each of said moveable plow sections having follower means engaging one guideway of each of said pairs, said actuator means being disposed between said pairs.

* * * * *